US005330257A

United States Patent [19]

Wurster

[11] Patent Number: 5,330,257

[45] Date of Patent: Jul. 19, 1994

[54] AUGER MINING MACHINE

[75] Inventor: Gary R. Wurster, Corbin, Ky.

[73] Assignee: Salem Tool, Inc., London, Ky.

[21] Appl. No.: 961,085

[22] Filed: Oct. 14, 1992

[51] Int. Cl.[5] ..... E21C 27/22; E21C 31/10

[52] U.S. Cl. ..... 299/56; 175/122; 299/68; 299/75

[58] Field of Search ..... 299/55, 56, 57, 68, 299/73, 75, 87; 175/88, 122

[56] References Cited

U.S. PATENT DOCUMENTS

| | | | |
|---|---|---|---|
| 1,614,030 | 1/1927 | Holmes | 299/75 |
| 1,635,780 | 7/1927 | Cartlidge | 299/75 |
| 1,648,879 | 11/1927 | Holmes | 299/75 X |
| 1,883,055 | 10/1932 | Stanley | 299/75 |
| 2,951,693 | 9/1960 | Carothers | 299/87 X |
| 2,979,320 | 4/1961 | Adams | 299/55 X |
| 3,131,916 | 5/1964 | Adams et al. | 175/122 X |
| 3,834,761 | 9/1974 | Ray et al. | 299/56 X |
| 3,881,558 | 5/1975 | Dolza | 175/122 X |
| 4,553,612 | 11/1985 | Durham | 175/122 |

*Primary Examiner*—David J. Bagnell
*Attorney, Agent, or Firm*—King and Schickli

[57] ABSTRACT

An auger mining apparatus includes a support frame holding a tilt platform. A tilt mechanism displaces the tilt platform at a pitch between 0°–45° relative to the support frame. A stacked, dual carriage arrangement is carried by the tilt platform. A bidirectional auger drive system is mounted to the upper carriage. The dual carriages are mounted for reciprocal movement along independent paths extending substantially perpendicular to one another. An auger clamp mounted to the tilt platform includes a pilot member for guiding auger sections and a mechanism allowing movement on the pilot member through two separate planes; the second perpendicular to the first. The auger clamp also includes a clamping/decoupling plate and a mechanism for moving the plate in a third plane orthogonal to the first and second planes. Thus, the pilot member with the clamping/decoupling plate may also be utilized to clamp and hold an auger line in position even in steeply pitched seams.

18 Claims, 7 Drawing Sheets

S
10
62
54
68
72
52
32
46
30
48
12
82
80
14
18
84
19
20
22
14
78a
78b
76a
12
76b
86
16
F

AUGER MINING MACHINE

TECHNICAL FIELD

The present invention relates generally to the mining field and, more particularly, to an improved auger mining machine particularly adapted for utilization in underground augering of thin and/or pitched seams.

BACKGROUND OF THE INVENTION

Coal is a fossil fuel formed primarily from vegetable matter decomposed without access to air under the influence of pressure, temperature, and moisture. Specifically, the process of coal formation begins with the accumulation of vegetable matter. The weight of the top layers of vegetable matter compact the lower layers. This is done primarily by squeezing out large amounts of water. Over time, the plant material is buried further by sediments with the loss of water and volatile materials resulting in the formation of lignite. With increasingly deeper burial increases in pressure occur that compress the lignite. The resulting compression effected by the increasing depth of burial further devolatilizes the coal so that the rank of coal becomes progressively higher rising from lignite to sub-bituminous, bituminous, semi-anthracite, anthracite and meta-anthracite stages.

As a result of the formation process, coal is generally found horizontally inclined underground in sedimentary rock sequences. Geologic/tectonic activity, however, causes these sequences or strata to be gently folded pitching the coal seams at inclines of up to 40–45%. While modern mining equipment operates with a relatively high degree of efficiency on moderate grades, operating problems limit or effectively prohibit operation of such equipment in seams pitched greater than approximately 10%.

More specifically, continuous miners are unable to maintain the necessary grip or traction to efficiently cut coal when either transversing or following step grades. Likewise, conventional mining equipment is difficult to bring into proper position for mining step grades. Further, step grade mining subjects the mining equipment to unusual stress that the equipment was not designed to bear. Accordingly, significant maintenance problems result leading to an increase in downtime for costly repairs and lost productivity. Thus, it should be appreciated that if pitched seam coal reserves are to be recovered, the need exists for the development of efficient and effective mining equipment for this purpose.

SUMMARY OF THE INVENTION

Accordingly, it is a primary object of the present invention to provide a new and improved underground auger mining apparatus and method allowing quick and efficient recovery of coal under less than ideal conditions.

Yet another object of the present invention is to provide an underground auger mining machine and method providing for the efficient recovery of coal. Such a machine is also particularly useful in recovering coal from thin seams where sufficient clearance does not exist for the application of conventional and continuous mining techniques.

Still another object of the invention is to provide an improved underground auger mining apparatus and method particularly adapted and useful for underground mining of pitched seams and especially seams pitched greater than 10% where operating problems limit or prevent efficient operation of continuous and conventional mining equipment.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for the underground auger mining of coal. The auger mining apparatus includes a main support frame that rests upon the mine floor and holds a tilt platform. Means are provided for selectively displacing the tilt platform at a pitch angle between 0°–45° with respect to the support frame so as to allow the auger mining of pitched seams.

A first guideway is provided on the tilt platform. A first carriage is cooperatively mounted on the first guideway so as to provide for reciprocating movement along a first path defined by the guideway. A second guideway is mounted on the first carriage. Similarly, a second carriage is cooperatively mounted on the second guideway so as to provide for reciprocating movement along a second path extending in a direction substantially perpendicular to the first path. Finally, an auger drive is mounted to the second carriage. Together, this dual stacked carriage arrangement being described allows the auger mining apparatus of the present invention to bore two auger holes while the support frame remains in a single, fixed position on the mine floor. Further, the unique carriage arrangement allows auger sections from the first hole to be removed from the first auger line, shuttled over and added to the auger line of the second hole in an efficient manner. Hence, high productivity is insured.

The apparatus also includes a propulsion system connected to the mainframe for moving the apparatus relative to the face of a seam being mined. Any propulsion system of a type known in the art suitable for this purpose may be utilized. For example, the apparatus may include a lift jack and skid propulsion system. Thus, after boring two auger holes the apparatus may be moved laterally along the face the width of a rib or web, e.g. the coal left between adjacent auger holes, and then a new bore hole started.

The apparatus also includes a system for recovering the coal being won by the auger. More particularly, a conveyor, such as a scraper chain conveyor, is mounted to the support frame. Additionally, a chute is mounted to the tilt platform. This chute functions to deliver coal, won from the hole being bored into the seam by the auger apparatus, to the conveyor. Specifically, the chute is pivotally mounted at one end to the tilt platform and a means such as a hydraulic cylinder is provided for selectively positioning the second, opposite end of the chute. Accordingly, the angle of the chute relative to the tilt platform may be adjusted to allow the efficient and effective delivery of coal to the conveyor no matter what pitch angle is assumed by the tilt platform.

The auger apparatus also includes a first auger clamp mounted to the tilt platform for not only guiding the auger during drilling but also securing the auger line in position as sections are added or removed from the line. More particularly, the first auger clamp includes a guide shoe that captures a track section of the tilt platform while providing sliding engagement. A substantially U-shaped pilot member is mounted on the guide shoe. Additionally, means are provided for moving the guide shoe relative to the tilt platform in a first plane. More particularly, this means allows the first auger clamp to be shifted laterally toward or away from a second auger clamp fixed to the tilt platform spaced from and parallel to the first auger clamp. Accordingly, this movement allows the spacing between bore holes to be varied so that the width of the web or rib between bore holes may be adjusted as required to support the overburden following the augering process.

The first auger clamp includes a means for moving the pilot member relative to the guide shoe in a second plane perpendicular to the first plane. More specifically, the pilot member may be extended toward or retracted from the face of the coal seam as may be required during the clamping and releasing operation. Additionally, the first auger clamp also includes a clamping/decoupling plate and means for moving the clamping/decoupling plate in a third plane orthogonal to the first and second planes. Both of these structures are mounted on the pilot member. Advantageously, by adjusting the relative position of the pilot member toward or away from the tilt member and coal face, the clamping-/decoupling plate may be brought into alignment with the latch that secures the auger drive coupling to the auger line. Accordingly, when the plate is raised, the latch is unlatched. The carriages may then be utilized to retract and position the auger drive for receipt of the next auger section.

In accordance with an additional important aspect of the present invention, the auger drive is bidirectional. Additionally, the support frame exhibits bilateral symmetry in two perpendicular directions. More specifically, the left and right sides are symmetrical and the front and rear sides are symmetrical. Accordingly, it should be appreciated that the tilt platform may be selectively displaced at a pitch angle between 0°–45° with respect to the main support frame in either of two opposing directions. Further, mounting of the auger clamps on each opposing side of the apparatus is possible. This "left or right hand" operation advantageously improves the flexibility of the apparatus allowing the apparatus to be more quickly positioned and made operative to recover coal from many of the various seam formations and underground passageway configurations that may be found.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
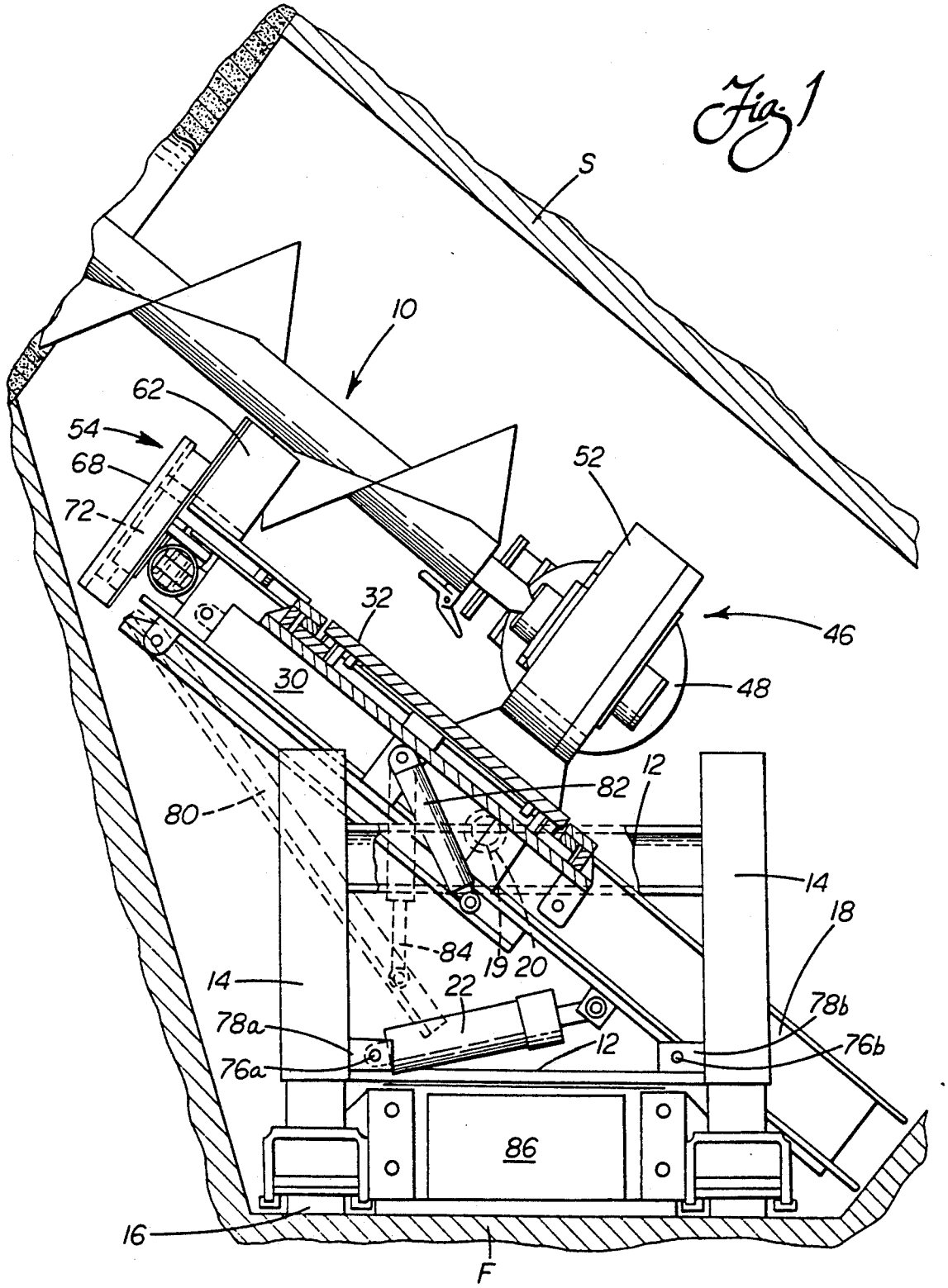
FIG. 1 is a left side elevational view of the auger mining apparatus 10 of the present invention showing the tilt platform thereof pitched at an angle of approximately 40° with respect to the support frame.

Reference is now made to FIG. 1 showing the auger mining apparatus 10 of the present invention. The auger mining apparatus 10 is particularly adapted for winning coal from a coal seam such as the pitched seam S shown.

The apparatus 10 includes a main support frame 12 that rests on the mine floor F during mining. The main support frame 12 includes a lift jack 14 at each of four corners. The lift jacks 14 cooperate with a skids 16 to propel the apparatus 10 along the mine floor in a manner known the art.

A tilt platform 18 is held on the support frame 12. More specifically, the tilt platform 18 is pivotally mounted to the support frame 12 by a pair of pivot pins 19 that extend through the tilt platform and are also received in cooperating yokes 20 fixed to the support frame 12. Only one of the pin and yoke arrangements is show in FIG. 1. It should be appreciated that the other pin and yoke arrangement is a mirror image of the one shown positioned at the opposite side of the apparatus.

The hydraulic cylinder 22 at each side of the apparatus 10 allows the tilt platform 18 to be pivoted about the pins 19 to any pitch angle between 0°–45° relative to the support frame 12 and floor F of the mine. Once again, only one hydraulic cylinder 22 is shown in FIG. 1. Again, however, it should be appreciated that the other cylinder is positioned in alignment with the one shown at the opposite side of the apparatus 10. The two cylinders 22 operate in tandem to provide the desired function.

Figure 2:
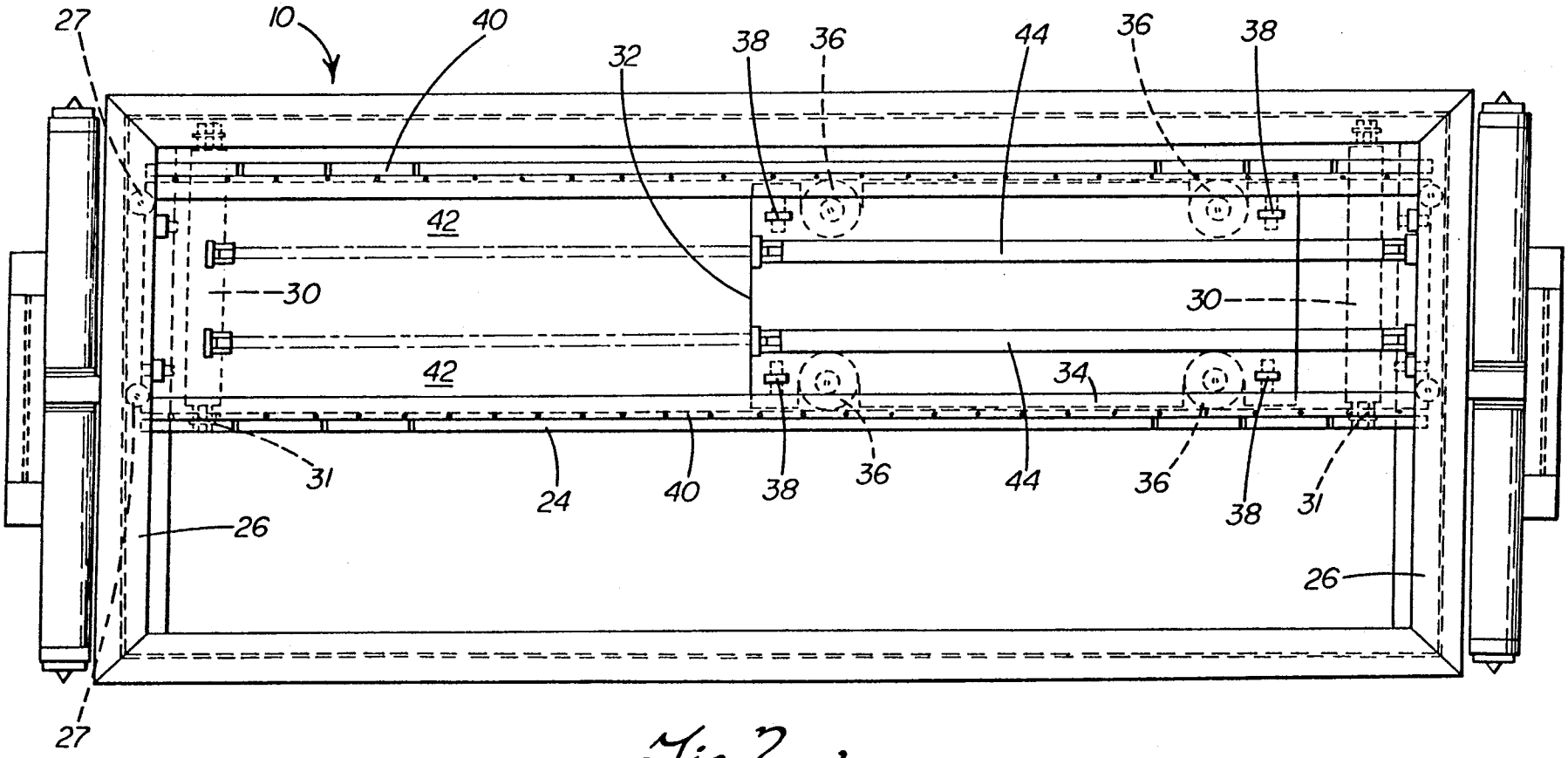
FIG. 2 is a top plan view of the apparatus shown in FIG. 1 with various structures removed to show in detail the dual stacked carriage arrangement.
Figure 3:
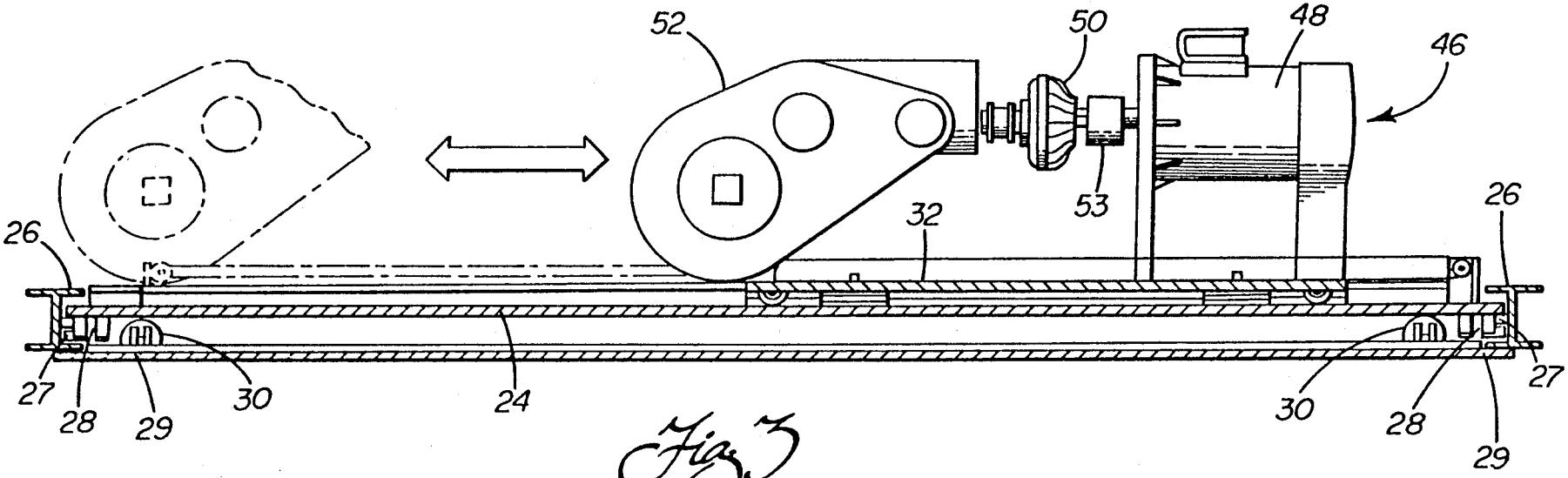
FIG. 3 is a detailed front elevational view also showing the dual stacked carriage arrangement.
Figure 4:
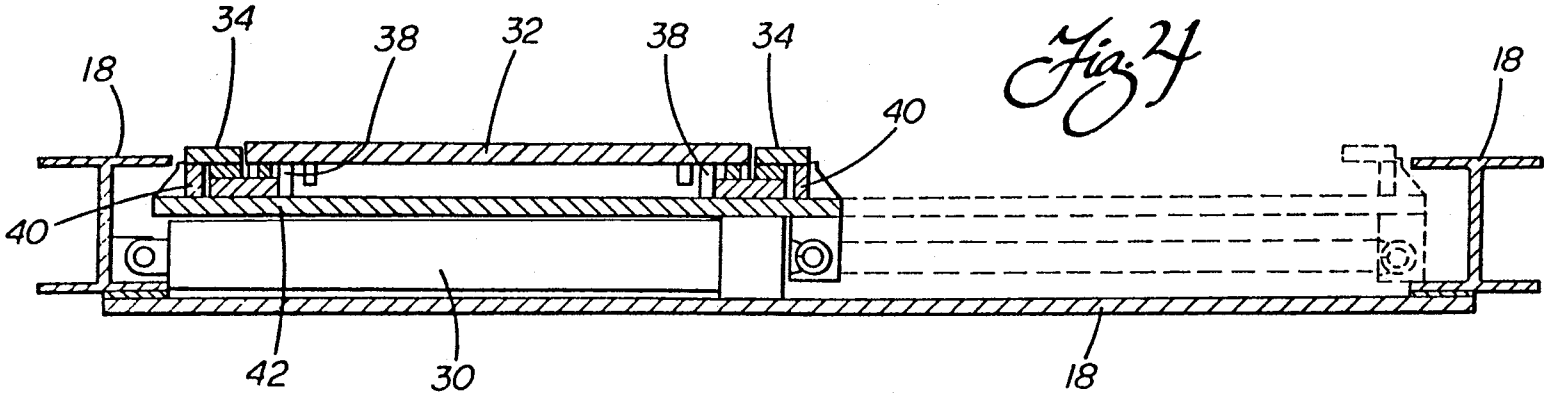
FIG. 4 is a detailed sectional view further demonstrating the dual stacked carriage arrangement.
Figure 5:
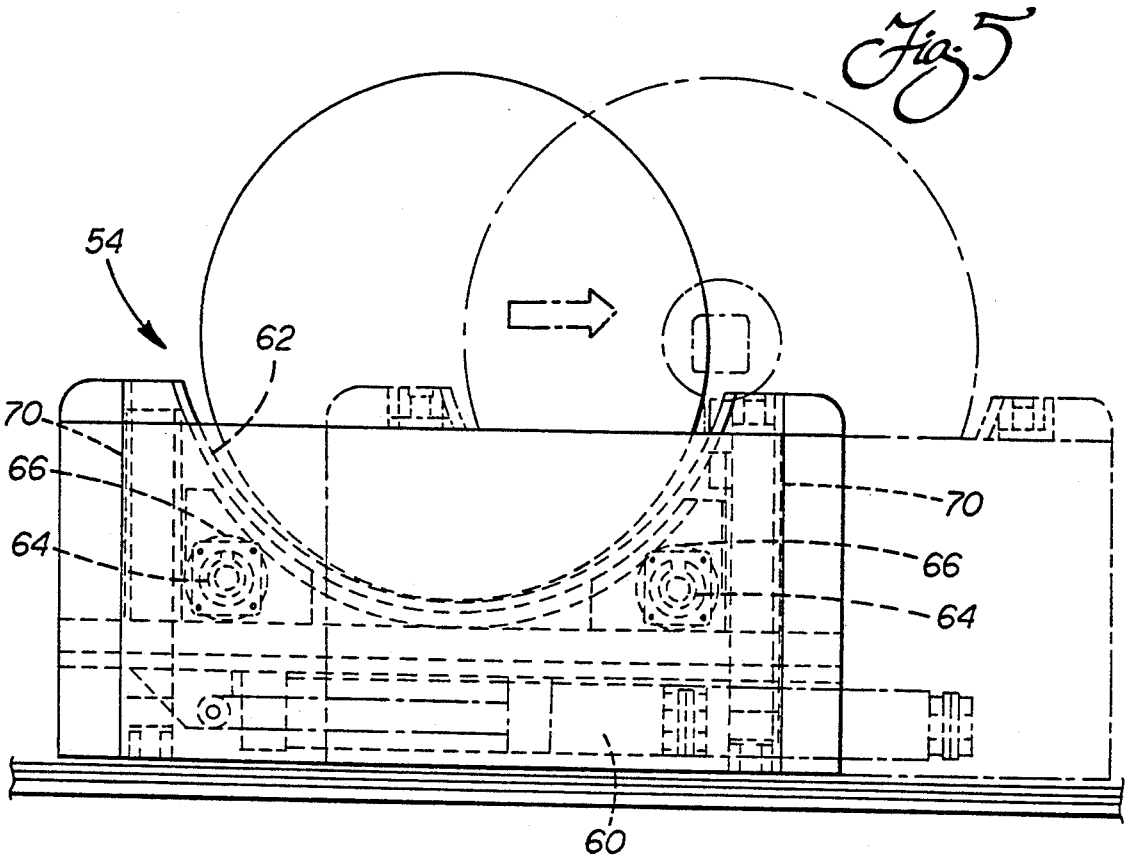
FIG. 5 is a detailed front elevational view illustrating the lateral shifting of the guide shoe of the first auger clamp-along the tilt platform.
Figure 6A:
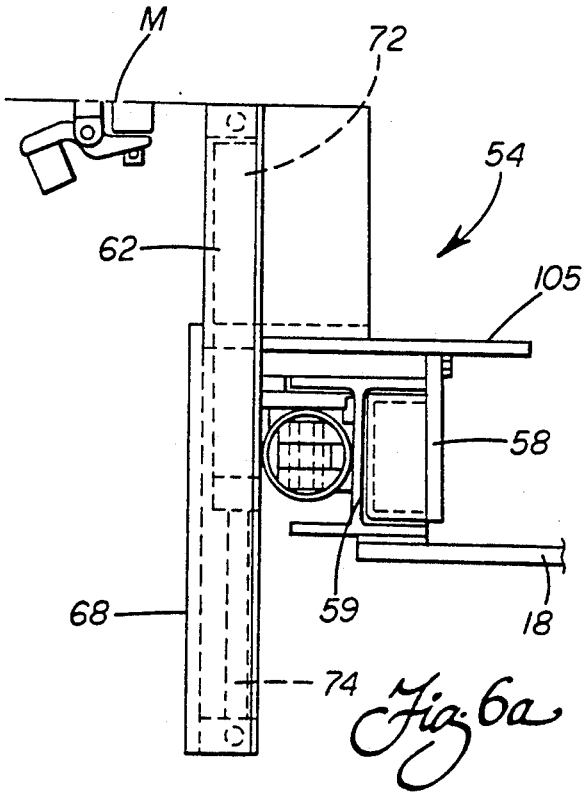
FIGS. 6*a* and 6*b* are detailed, partially sectional side elevational views illustrating the fully extended and retracted positions of the pilot member of the first auger clamp shown in FIG. 5.
Figure 6B:
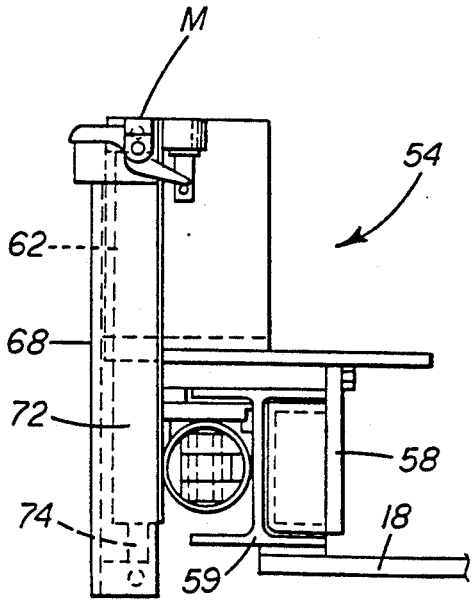
Figure 7:
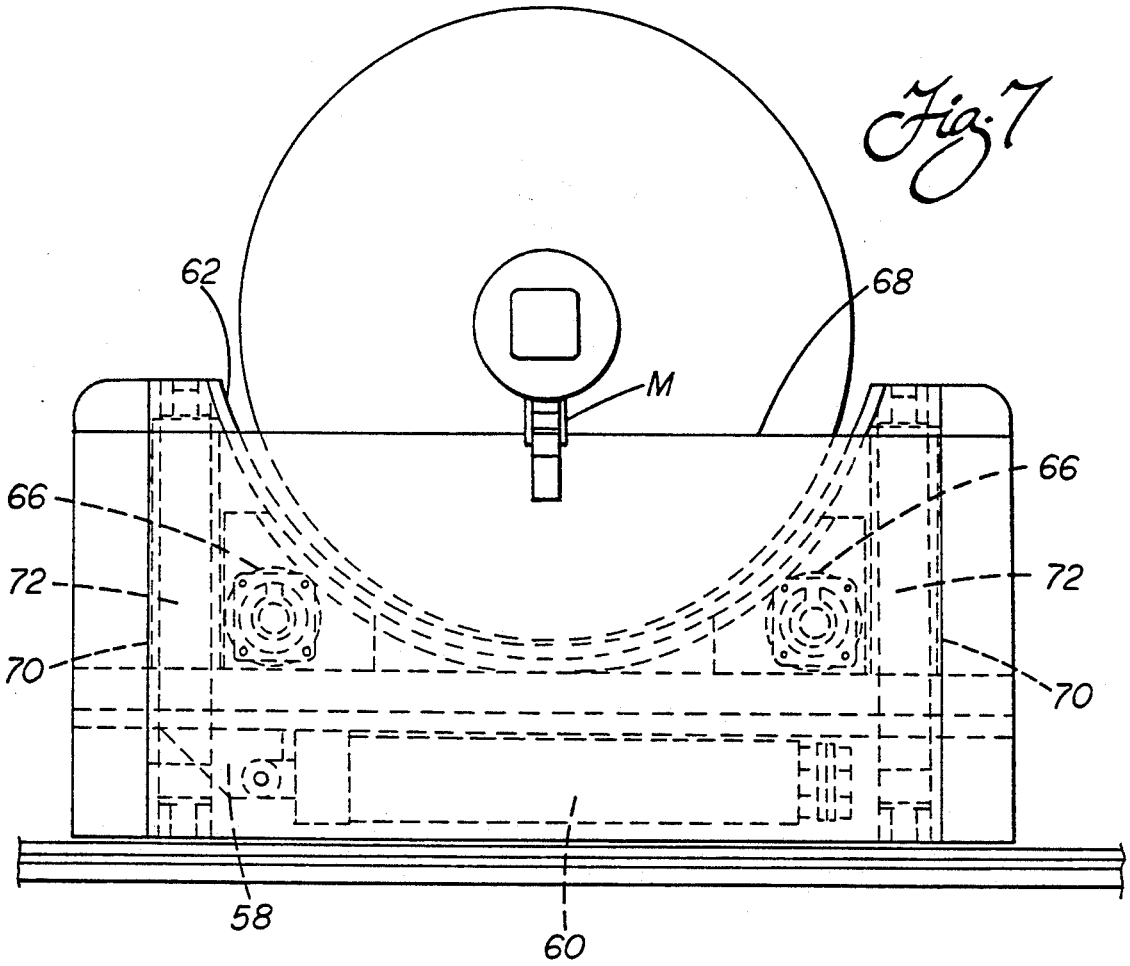
FIG. 7 is a detailed front elevational view showing the fully raised and lowered positions of the clamping-/decoupling plate of the first auger clamp.

As shown in detail in FIGS. 2, 3 and 4, a first carriage 24 is mounted on the tilt platform 18. More specifically, the carriage 24 is received in a first guideway 26 formed by opposing I-beam members at each side of the apparatus 10. As shown, the carriage 24 includes first and second sets of rollers 27, 28. The rollers 27 engage the I-beam guideways 26 while the rollers 28 ride over the support ways 29. A pair of hydraulic cylinders 30, one adjacent each side of the carriage 24, operate in tandem to drive the carriage along a first path alternately toward or away from the face of the coal seam S. Specifically, the cylinders 30 are fixed to the tilt platform 18 while the rods 31 are connected to the carriage 24.

A second, smaller carriage 32 is similarly mounted for reciprocal movement along a second guideway 34 fixed to the first carriage 24. More specifically, two sets of rollers 36, 38 are mounted to the second carriage 32. The first set 36, engage in opposing tracks 40 formed by the lead and trailing members of the first carriage 24. The second set of rollers 38 run along the underlying support ways 42 of the first carriage 24. A pair of hydraulic cylinders 44, mounted to the first carriage 24 and having rod ends connected to the second carriage 32, operate in tandem to drive the second carriage along a second path back-and-forth in a direction transverse to or across the coal face. Thus, as will be appreciated, the second path is substantially perpendicular to the first path.

An auger drive system, generally designated by reference numeral 46, is mounted to and carried by the second carriage 32. The auger drive system 46 includes a drive motor 48, fluid coupling 50, auger transmission 52 and clutch 53 all of a type generally known in the art.

Referring now again to FIG. 1, two auger clamps, generally designated by the reference numerals 54, 56, respectively, are mounted in parallel to the tilt platform 18. As shown in detail in FIGS. 5, 6*a*, 6*b* and 7, the first auger clamp 54 includes a guide shoe 58 that engages and captures a track section 59 of the tilt platform 18 while allowing reciprocal movement therealong. More specifically, a hydraulic cylinder 60, fixed to the tilt platform 18 and having a rod end connected to the guide shoe 58, may be retracted or extended to shift the shoe laterally along the tilt platform. In contrast, the second auger clamp 56 is mounted in a fixed position on the tilt platform 18. As explained in greater detail below, it should be appreciated that the lateral shifting of the first auger clamp 54 relative to the second auger clamp 56 allows the relative width of the web or ribs of coal left between the bore holes to support the overburden to be varied depending upon the particular requirements of the mining site.

Both the auger clamps 54, 56 include a substantially U-shaped pilot member 62. As shown with reference to drawing FIGS. 6*a*, 6*b*, the pilot member 62 is mounted on the guide shoe 58. More specifically, the pilot member 62 is carried by the rods 64 of a pair of tandem hydraulic cylinders 66 that are fixed to the guide shoe 58. Accordingly, the pilot member 62 may be selectively extended away from or retracted toward the tilt platform 18. A similar tandem cylinder arrangement provides identical movement to the pilot member 62 of the second auger clamp 56. The cylinders, however, are mounted directly to the tilt platform 18.

Additionally, the two auger clamps 54, 56 are each equipped with a clamping/decoupling plate 68. Each plate 68 is received for sliding movement in a guide track 70 formed in the associated pilot member 62. A pair of tandem hydraulic cylinders 72 are provided to move the clamping/decoupling plates 68 relative to the pilot members 62. Each cylinder 72 is fixed to the associated pilot member 62 with the rod ends thereof fixed to the opposing sides of the associated plate 68. Accordingly, when the rods 74 are drawn into the cylinders 72 in tandem, the associated plate 68 is raised.

It should be appreciated that by adjusting the relative position of the pilot member 62 and, therefore, the clamping/decoupling plate 68 carried thereon, it is possible to bring the plate into alignment with the latch mechanism M of a type known in the art (see U.S. Pat. No. 4,021,126) that secures auger sections together as well as the auger line to the drive coupling. Accordingly, when the plate 68 is fully raised, the latch mechanism M is tripped and thereby unlatched (see FIG. 7). As described in greater detail below this then makes it possible to quickly and efficiently add or remove an auger section from the auger line. Further, it should be appreciated that this is done while the raised plate 68 simultaneously serves to hold the auger line in the bore hole even when operating at a pitch angle of up to 45°.

In accordance with another aspect of the invention, the apparatus 10 is of modular design allowing quick assembly/disassembly. This allows the apparatus 10 to be quickly broken down and moved through relatively tight underground passages to another mining location. There, the apparatus 10 may again be quickly reassembled for operation. It should further be appreciated that the apparatus 10 has bilateral symmetry in two perpendicular directions. This allows the pin 76*a*, 76*b* and yoke 78*a*, 78*b* arrangements to be reversed with the cylinders 22. Thus, the tilt platform 18 may be pitched in either direction. Further, the auger clamps 54, 56 may be mounted on either side as required when reassembled. The bidirectional auger drive may then be utilized to drill either left or right as shown in FIG. 1. This provides the apparatus 10 with additional flexibility in operation so that efficient coal recovery is always possible.

Coal won during augering falls from the bore hole onto a chute 80. One end of the chute 80 is pivotally mounted to the tilt platform 18. The other end of the chute 80 is connected to the rod 84 of the cylinder 82 that is also pivotally mounted to the tilt platform 18. Accordingly, by adjusting the extension of the rod 84, the chute angle may be adjusted to discharge the coal directly upon an underlying scraper chain conveyor 86 held in the support frame 12. One chute 80 for this purpose is mounted aligned with each auger clamp.

The operation of the auger mining apparatus 10 will now be described in detail. Initially, a mining site is selected for augering. Typically, an entry is driven along the strike and then the apparatus 10 is utilized to recover coal in the up-pitch pillar or seam S. The seam S, of course, must be of an appropriate height to allow augering and may have a pitch angle of anywhere between 0°–45° with respect to the horizontal.

Prior to augering, the apparatus 10 is broken down and moved underground to the mining site. The apparatus 10 is then assembled and moved by means of its self propulsion system (lift jacks 14, skids 16) to an operative position adjacent to and extending along the face of the seam S. Auger sections of desired diameter, depending upon the thickness of the seam S, are then delivered to the apparatus by a monorail conveyor, shuttle car or any other method known in the art.

Next, the web or rib dimension is set by adjusting the relative position of the first auger clamp 54 by means of the cylinder 60. For purposes of this illustration, a full width web will be left intact to support the overburden.

Figure 8A:
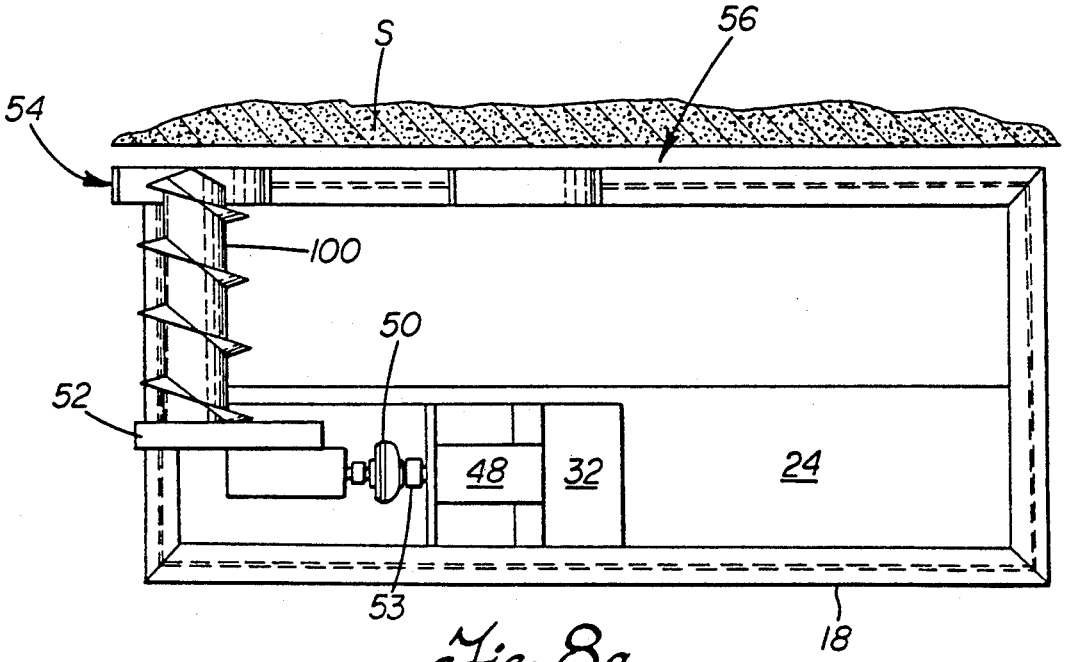
FIGS. 8*a*–8*g* are schematical plan representations illustrating the operation of the auger mining apparatus of the present invention.
Figure 8B:
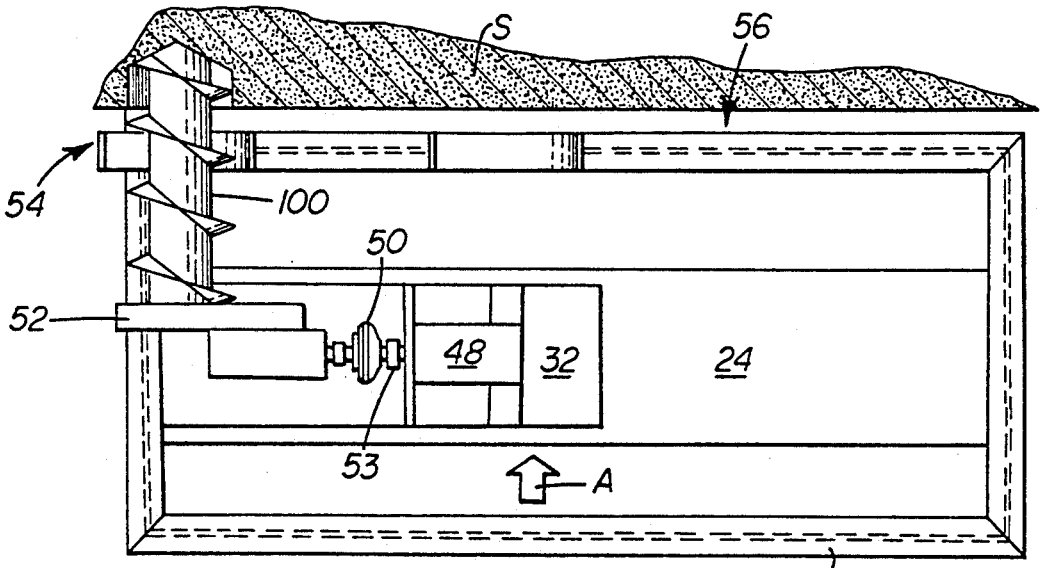

Accordingly, as shown in FIG. 8*a*, the first carriage 24 is fully retracted and the second carriage 32 is fully extended to the left hand most position. An auger drill head 100 is then positioned onto the fully retracted pilot member 62 of the fist auger clamp 54 and connected or latched to the transmission 52. Anchor jacks (not shown) are then extended between the floor and ceiling in order to secure the apparatus 10 in position in a manner known in the art. The drive motor 48 is then activated and the transmission 52 engaged via clutch 53 and fluid coupling 50 to rotate the auger drill head 100. Simultaneously, the tandem cylinders 30 are activated to advance the first carriage 24 in the direction of action arrow A (see FIG. 8*b*) toward the seam S. This operation continues until the first carriage 24 is fully advanced.

At that time, the drive motor 48 is disconnected from the auger 100 by means of the clutch 53. Next, the pilot member 62 of the first auger clamp 54 is extended toward the seam face by operation of the tandem cylinders 66. Once the clamping/decoupling plate 68 is aligned with the latch M securing the auger drive transmission 52 to the auger line 100, the clamping/decoupling plate 68 is raised by action of the cylinders 72. When raised, the plate 68 engages and releases the latch M between the drive transmission 52 and the auger 100.

Figure 8C:
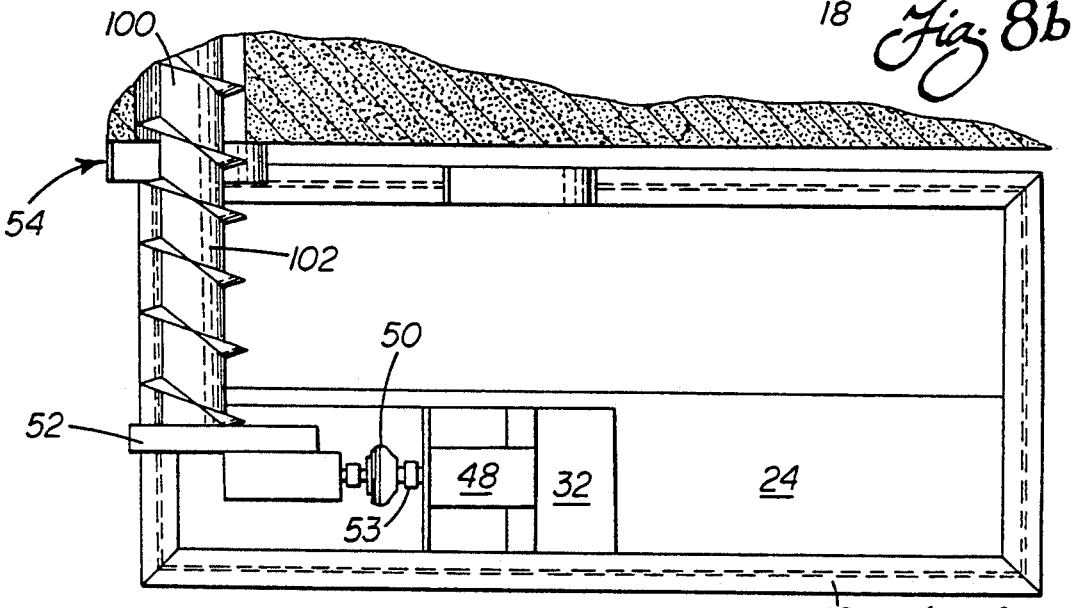

The first carriage 24 is then fully retracted to the position shown in FIG. 8*c* and the next section of auger 102 is positioned with the leading end resting on the ledge 105 of clamp 54. The trailing end is then latched and supported by drive transmission 52. While this is done, the raised plate 68 ensures that the auger line 100 in the bore hole is held in position. Next, the carriage 24 is advanced slightly to bring the new auger section 102 into engagement with the auger line 100 as shown in FIG. 8*c*. First the plate 68 and then the pilot member 62 are retracted and the new section 102 is latched to the auger line 100. The drive motor 48 is then reconnected to the auger line 100 by engagement of clutch 53 operating coupling 50 and transmission 52. Simultaneously, the carriage 24 is advanced in the direction of action arrow B with reference to FIG. 8*d* until the forward limit is again reached. A new auger section is then added again in the manner described. This procedure continues until full depth of penetration is reached. It is then necessary to start a new auger hole.

More specifically, after extending the pilot member 62 and raising the plate 68 to release the auger line latch M, the first carriage 24 is retracted. The second carriage 32 is then laterally shifted to the right (note action arrow C in FIG. 8*e*) by operation of the tandem cylinders 44 to bring the transmission 52 into alignment with a second auger clamp 56. A new auger head 104 is then positioned in the pilot member 62 of the second auger clamp 56 and latched at the rear end through the transmission 52. Next, the transmission 52 is engaged with clutch 53 and the first carriage 24 is advanced toward the seam S (note action arrow D in FIG. 8*f*). As this is done, coal is won. The coal spills from the bore hole by operation of the auger and falls onto the underlying chute 80 of the type previously described that directs the coal onto the conveyor 86 for recovery.

Figure 8D:
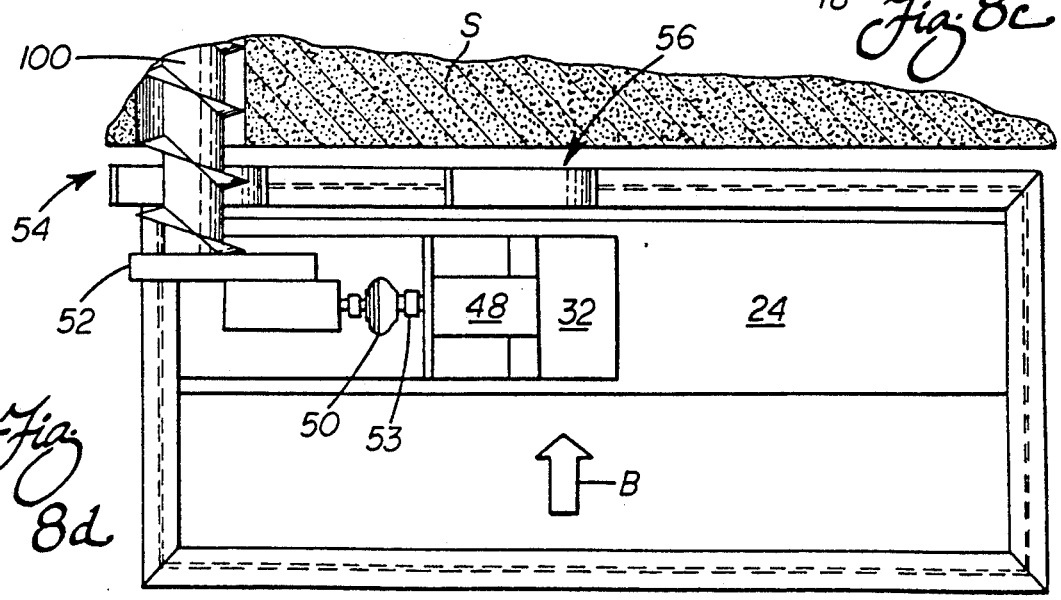
Figure 8E:
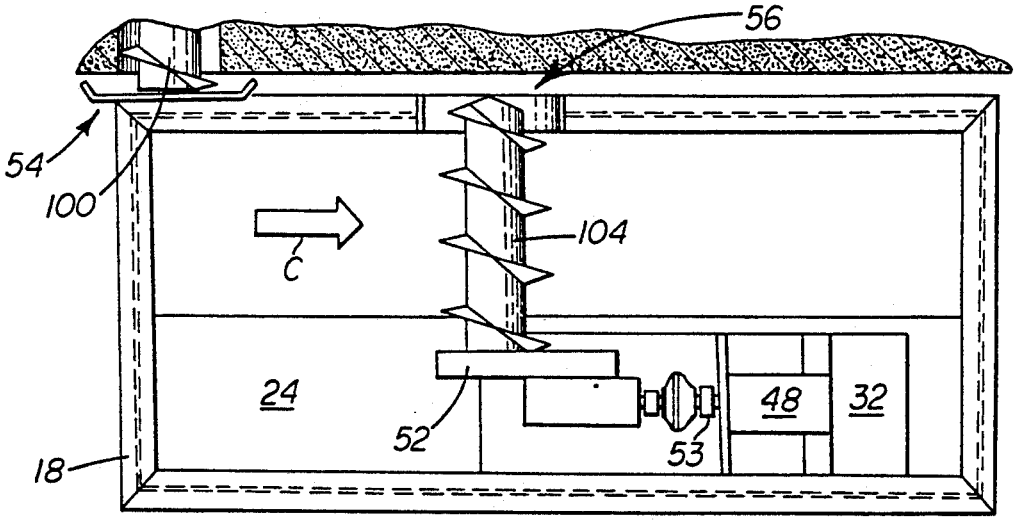
Figure 8F:
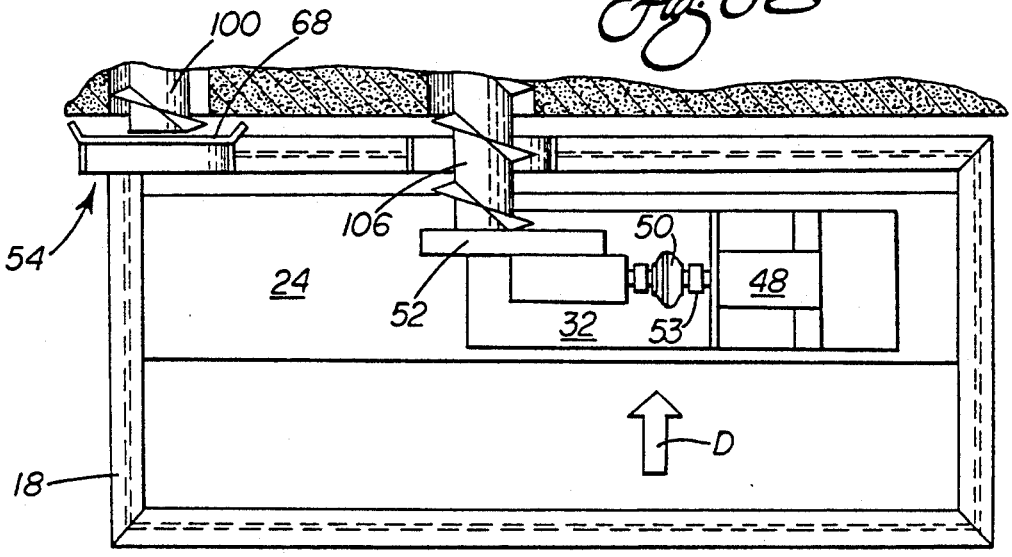

Once fully advanced, the pilot member 62 of the second auger clamp 56 is extended and the plate 68 is raised in a manner previously described to unlatch latch M and clamp the new auger line 106 in position. The carriage 24 is then partially withdrawn or retracted and the second carriage 32 is then laterally shifted to the left to align the auger transmission 52 with the first auger clamp 54 and first auger line 100. The carriage 24 is then fully advanced as shown in FIG. 8*d* to bring the transmission 52 into engagement with the rearmost section of the first auger line 100. The plate 68 and the pilot member 62 of the first auger clamp 54 are then retracted and the transmission 52 is latched to the rearmost auger section.

Next, the clutch 53 is engaged and the auger line 100 is rotated while cylinders 30 supply force to extract the rearmost section. As this is done, the carriage 24 is fully retracted to a position corresponding to that shown in FIG. 8*c*. The motor 48 is then disengaged by means of the clutch 53. Next the pilot member 62 is shifted by operation of the cylinders 66 to bring the plate into alignment with the latch mechanism between the last two auger sections of the line 100. The plate 68 is then raised by operation of the cylinders 72 to unlatch the rearmost auger section.

Figure 8G:
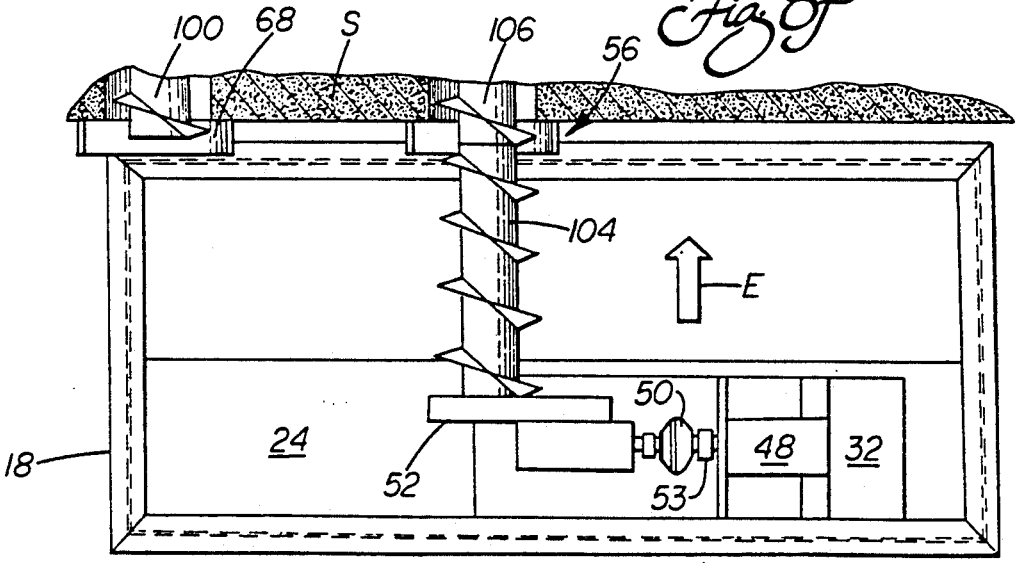

Once unlatched, the carriage 24 is retracted slightly away from the seam to provide clearance and the carriage 32 is shifted laterally back to the right so as to align the auger section with the new auger line 106. The carriage 24 is then advanced to bring the new auger section into engagement with the new auger line 106. The plate 68 of the second auger clamp 56 is then lowered, the pilot member 62 retracted and the new section latched to the new line. The clutch 53 is then engaged so that the motor 48 now drives the new auger line 106. Simultaneously, the carriage 24 is advanced in the direction of action arrow E (see FIG. 8*g*).

This procedure is repeated until the second auger line reaches a full depth of penetration. The auger apparatus 10 is then advanced the spacing distance of the bore holes by means of the jacks 14 and skids 16. Then the procedure described is repeated until the full length of the seam has been mined.

In summary, numerous benefits result from employing the concepts of the present invention. Specifically, the auger mining apparatus 10 of the present invention may be efficiently utilized to drill adjacent auger holes removing auger sections from the first hole and utilizing them to drill the second. Advantageously, the unique dual stacked carriage arrangement and auger clamps allow very efficient operation by providing accurate motion and rapid cycling. Additionally, the bidirectional auger drive and bilateral symmetry of the apparatus 10 in conjunction with the modular design allows the apparatus 10 to be quickly broken down and reassembled as necessary when moving from one mining location to another.

The foregoing description of a preferred embodiment of the invention has been presented for purposes of illustration, and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed is:

1. An auger mining apparatus for winning mineral from a seam, comprising:

a support frame;

a tilt platform held on said support frame and including a first guideway;

means for selectively displacing said tilt platform at a pitch angle between 0°–45° with respect to said support frame;

a first carriage cooperatively mounted on said first guideway so as to provide for reciprocating movement along a first path, said first carriage including a second guideway;

a second carriage cooperatively mounted on said second guideway so as to provide for reciprocating movement along a second path extending in a direction substantially perpendicular to said first path; and an auger drive mounted to said second carriage.

2. The auger apparatus set forth in claim 1, further including propulsion means for moving said apparatus relative to a face of said seam being mined.

3. The auger apparatus set forth in claim 1, further including conveyor means for recovering won mineral from said seam mounted on said support frame.

4. The auger apparatus set forth in claim 3, further including a chute mounted to said tilt platform for delivering mineral, won from a hole being bored into said seam by said auger apparatus, to said conveyor means.

5. The auger apparatus set forth in claim 1, further including a first auger clamp mounted to said tilt platform.

6. The auger apparatus set forth in claim 5, wherein said first auger clamp includes:

a guide shoe for providing sliding engagement with said tilt platform;

a substantially U-shaped pilot member mounted on said guide shoe; and means for moving said guide shoe relative to said tilt platform in a first plane.

7. The auger apparatus set forth in claim 6, wherein said first auger clamp further includes means for moving said pilot member relative to said guide shoe in a second plane perpendicular to said first plane.

8. The auger apparatus set forth in claim 7, wherein said first auger clamp further includes a clamping-/decoupling plate and means for moving said clamping-/decoupling plate in a third plane orthogonal to said first and second planes, both said clamping/decoupling plate and means for moving same being mounted to said pilot member.

9. The auger apparatus set forth in claim 5, including a second auger clamp mounted to said tilt platform spaced from and parallel to said first auger clamp.

10. The auger apparatus set forth in claim 1, wherein said auger drive is bidirectional so as to allow augering in either of two opposing directions.

11. The auger apparatus set forth in claim 10, wherein said means for selectively displacing said tilt platform at a pitch between 0°–45° with respect to said support frame function in either of two opposing directions.

12. The auger apparatus set forth in claim 11, further including conveyor means for recovering won mineral from said seam mounted on said support frame.

13. The auger apparatus set forth in claim 12, further including a chute mounted to said tilt platform for delivering won mineral, won from a hole being bored into said seam by said auger apparatus, to said conveyor means.

14. The auger apparatus set forth in claim 11, further including a first auger clamp mounted to said tilt platform.

15. The auger apparatus set forth in claim 14, wherein said first auger clamp includes:

a guide shoe for providing sliding engagement with said tilt platform;

a substantially U-shaped pilot member mounted on said guide shoe; and means for moving said pilot member relative to said tilt platform in a first plane.

16. The auger apparatus set forth in claim 15, wherein said first auger clamp further includes means for moving said pivot member relative to said tilt platform in a second plane perpendicular to said first plane.

17. The auger apparatus set forth in claim 16, wherein said first auger clamp further includes a clamping-/decoupling plate and means for moving said clamping-/decoupling plate in a third plane orthogonal to said first and second planes, both said clamping/decoupling plate and means for moving same being mounted to said pilot member.

18. The auger apparatus set forth in claim 17, including a second auger clamp mounted to said tilt platform spaced from and parallel to said first auger clamp.

* * * * *

UNITED STATES PATENT AND TRADEMARK OFFICE

CERTIFICATE OF CORRECTION

PATENT NO. : 5,330,257

DATED : July 19, 1994

INVENTOR(S) : Gary R. Wurster

It is certified that error appears in the above-indentified patent and that said Letters Patent is hereby corrected as shown below:

Column 10, line 14, add the word --angle-- following the word "pitch".

Signed and Sealed this

Second Day of April, 1996

Bruce Lehman

*Attest:*

BRUCE LEHMAN

*Attesting Officer*

*Commissioner of Patents and Trademarks*